US006739003B1

(12) United States Patent
Fanuzzi

(10) Patent No.: US 6,739,003 B1
(45) Date of Patent: May 25, 2004

(54) MULTIPURPOSE TREATMENT TABLE

(76) Inventor: John M. Fanuzzi, Highway 89 Seven Point Ranch, Emigrant, MT (US) 59027

( * ) Notice: Subject to any disclaimer, the term of this patent is extended or adjusted under 35 U.S.C. 154(b) by 0 days.

(21) Appl. No.: 10/186,583

(22) Filed: Jul. 1, 2002

Related U.S. Application Data

(60) Provisional application No. 60/303,606, filed on Jul. 6, 2001.

(51) Int. Cl.[7] ..... A61G 7/015; A61G 9/00; A61G 13/08

(52) U.S. Cl. ..... 5/606; 5/618; 4/547; 4/622

(58) Field of Search ..... 5/606, 600, 613, 5/618; 4/547, 546, 622; 132/73.5

(56) References Cited

U.S. PATENT DOCUMENTS 668,636 A * 2/1901 Gregg ..... 5/606
692,061 A * 1/1902 McCullough ..... 5/606
987,189 A * 3/1911 Thorner ..... 5/606
1,039,708 A * 10/1912 Denquer ..... 5/606
4,075,457 A 2/1978 Williams
D346,043 S 4/1994 Galati
5,423,861 A 6/1995 Kelly
5,581,830 A * 12/1996 Schwieker ..... 5/606
D412,600 S 8/1999 Oh et al.
D429,379 S 8/2000 Kim
D429,380 S 8/2000 Fontier et al.
D457,018 S * 5/2002 Park ..... D6/495

FOREIGN PATENT DOCUMENTS

WO WO 00/28935 3/2000

* cited by examiner

*Primary Examiner*—Alexander Grosz
(74) *Attorney, Agent, or Firm*—Dennis A. Bennett

(57) ABSTRACT

There is disclosed a treatment table that has a footbath in the leg section. The treatment table can be positioned in many different configurations.

7 Claims, 3 Drawing Sheets

MULTIPURPOSE TREATMENT TABLE

This application claims priority under 35 US 119(e) of U.S. provisional application Serial No. 60/303,606, filed Jul. 6, 2001.

FIELD OF THE INVENTION

The present invention relates to tables used in treatment of patients and in particular to a massage table with a footbath in the center of the leg panel.

BACKGROUND OF THE INVENTION

Massage tables with motorized lift sections are well known in art. (See U.S. Pat. No. 5,423,861) These tables allow for a patient to be positioned in a flat position or the sections of the table can be individually raised or lowered to put the patient in a vast variety of positions.

There is also disclosed in the art numerous chairs for a patient to sit and place the feet in a bath. U.S. Des. Pat. No. 429,380 and U.S. Des. Pat. No. 429,370 both disclose a pedicure chair design for this purpose. U.S. Pat. No. 4,075,457 discloses a bench unit with a variety of compartments of such a height to enable a seated patient to rest the feet in the open compartments. The compartments are fitted with removable feet bath tubs.

A major disadvantage of the prior massage tables is that they do not include a foot section with a foot bath tub to receive a patient's feet for treatment.

SUMMARY OF THE INVENTION

The instant invention provides a massage table that has a tub capable of receiving one or both of the patient's feet within the leg section of the table.

In another form, the massage table is motorized to lift mechanically the different sections of the table independent from the other sections. In the leg section there is a footbath for receiving the patient's feet.

DETAILED DESCRIPTION OF THE PREFERRED EMBODIMENTS

Figure 1:
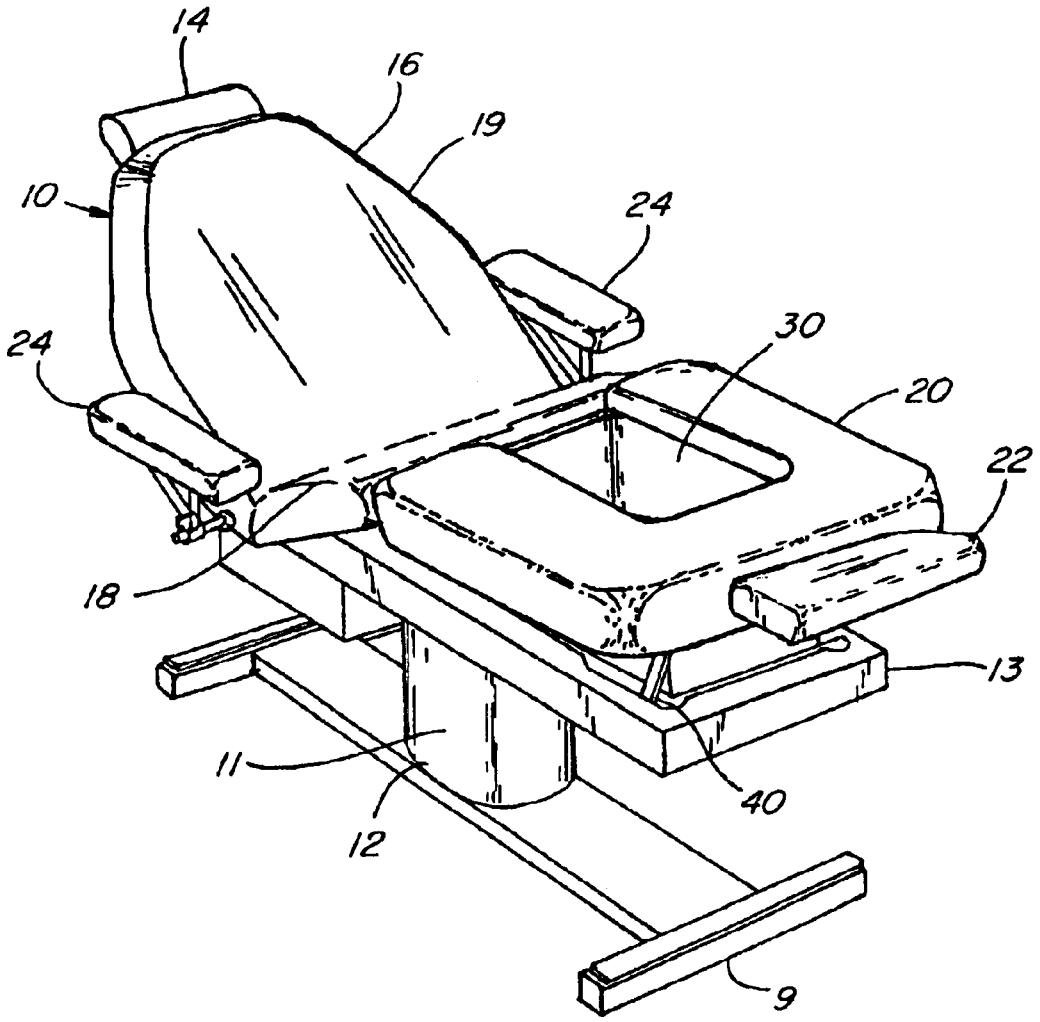
FIG. 1 is a front elevated view of one of the embodiment of the multipurpose massage table.
Figure 2:
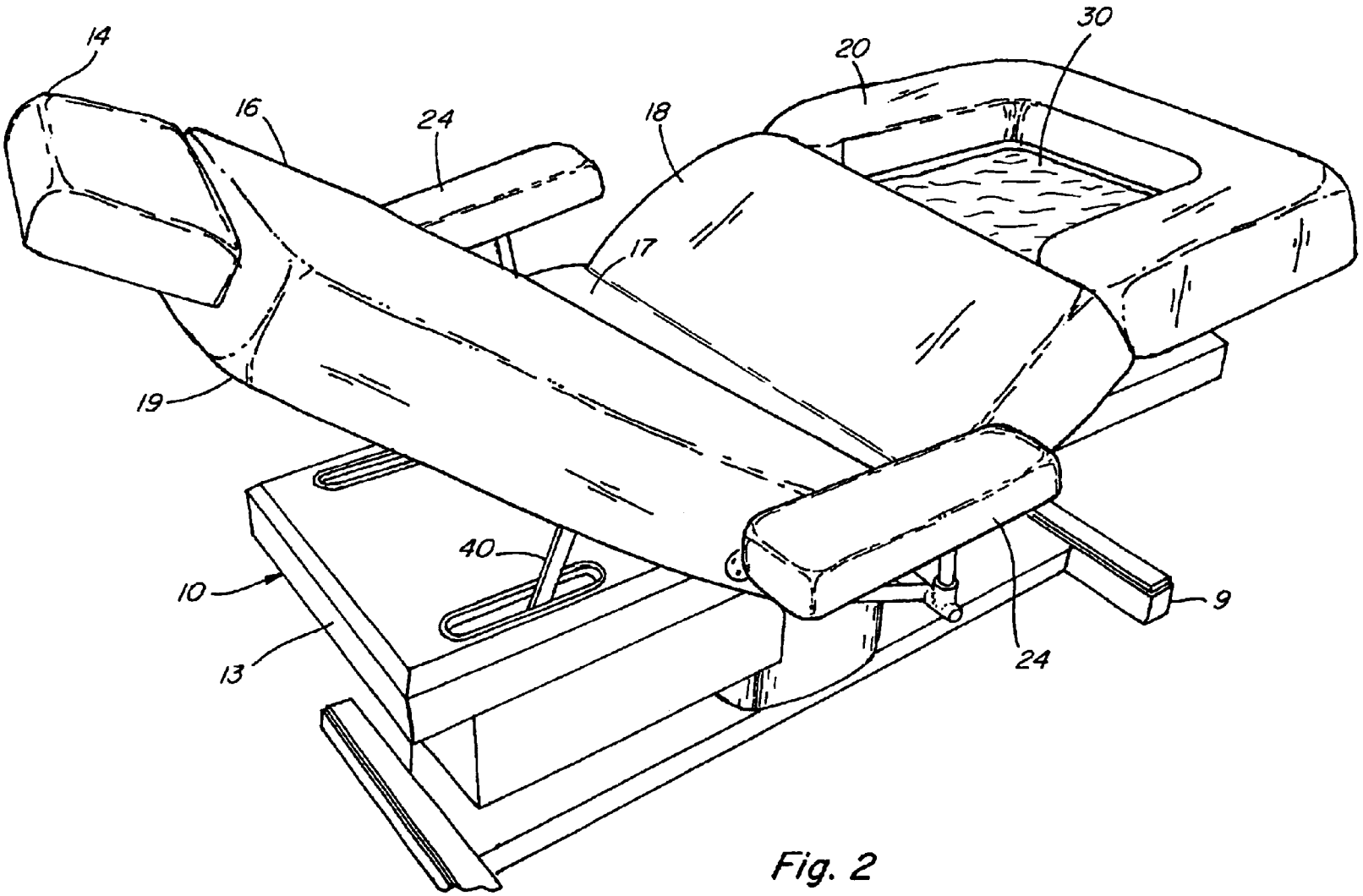
FIG. 2 is a rear elevated view of one of the embodiments of the multipurpose massage table with water in the footbath tub.

Referring to FIGS. 1 and 2 are an embodiment of the massage table 10, which includes a base frame assembly 12. In one embodiment base assembly 12, as shown in FIGS. 1 and 2, is comprised of a foot 9, an upright support 11 and a base assembly top 13. However other type of base assemblies can be used such as without the base top 13. In another embodiment the base frame 12 can be standard legs or any other design that will support the table top 19.

Supported above the base frame assembly 12 is a table top 19 which comprises an optional head support section 14, an abdominal or upper support section 16 which can also be shaped to function as the head support, optional pivot support section 17, a pelvic or center support section 18 and a foot support section 20. At the end of the foot support section 20 is an optional footrest 22.

Attached to abdominal support section 16 is optional arm support 24. The arm support 24 can pivot below table 16 when not needed.

Figure 3:
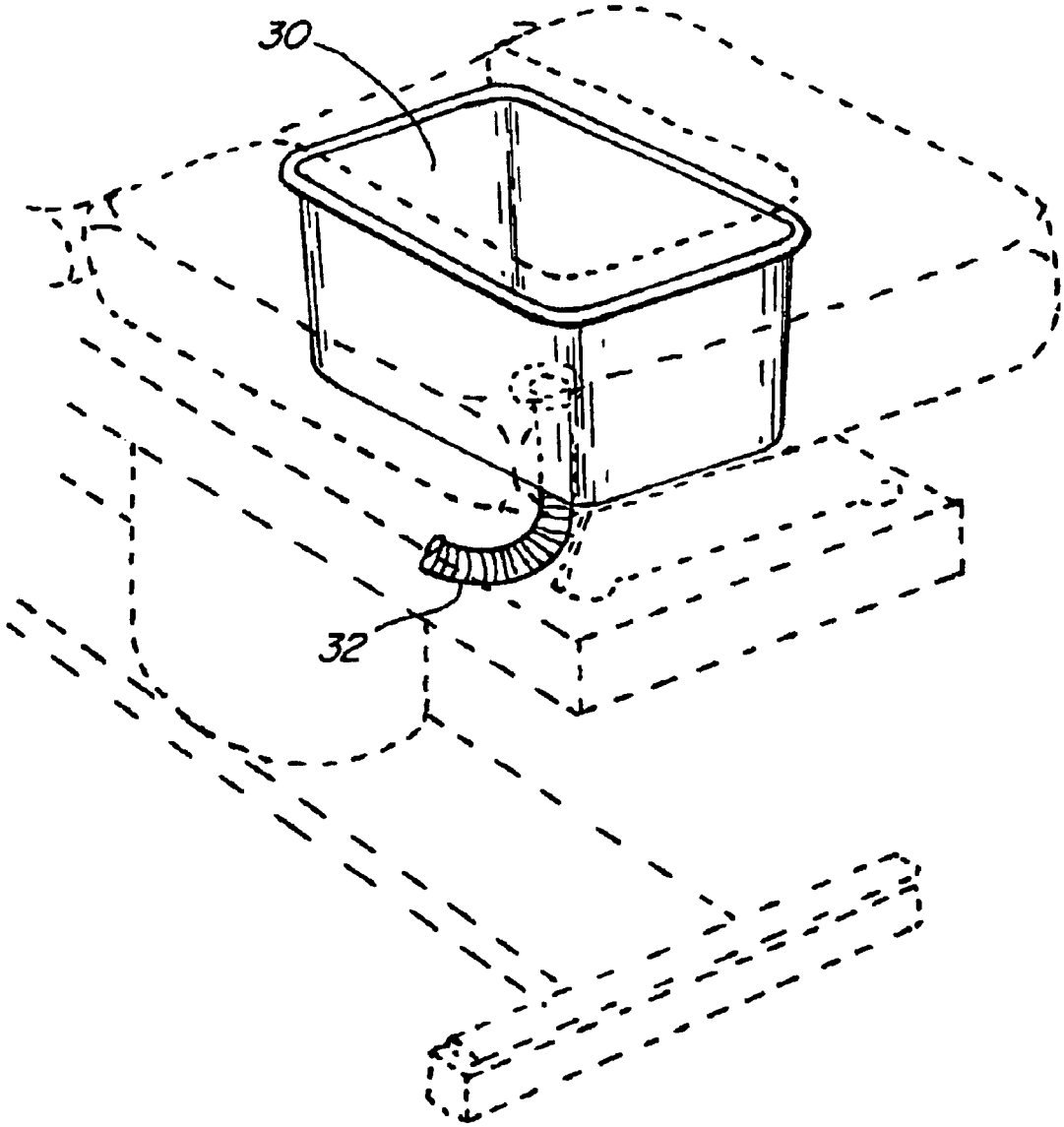
FIG. 3 is a cutaway view illustrating one embodiment of the footbath with a drain assembly to allow for discharge of the used water.

Within foot support section or caudal section 20 is bath tub 30. Bath tub 30 can be removable thereby allowing the used water to be dumped out. In FIG. 3 bath tub 30 is shown being permanently attached with a drain hose allowing for discharge of used water. When fresh water is added, a plug, valve or the like, is used to prevent discharge until desired.

A cushion or cover plug can be installed which is sized to fit the size of the opening of the footbath or tub 30. The cushion insert is normally made of the same material as the top section of the table 10.

In one of the embodiments, as shown in FIGS. 1 and 2 the top sections of the table 10 are lifted and lowered independently using rods 40 attached to normal lift mechanisms. However a variety of "lift mechanisms" are known in the art such as electric motors, non-electric hydraulic lifts, gas spring assisted lifts and pneumatic lifts or a manual system like a ratchet or strut support system. Foot pedals are normally installed on the table 10 to allow for hands free lifting of the table and/or table top sections 16, 18, and 20 together or independently.

In another embodiments the lift mechanisms 40 are not used. The tabletop 19 is attached directly to the base assembly 12. This is a preferable means when the table 10 is intended to be portable.

Tabletop sections 16, 18 and 20 can be adjusted to create a single plane for the patient to recline thereby allowing the table 10 to be used as a normal massage table. When used in this mode a foot bath plug or cover (not shown) can be installed.

When the patient's feet are to be worked on the footbath plug is removed to allow one or both feet to be put in the tub 30. Depending on the type of treatment, the tub can be filled with water or the like. In some cases, the tub will be empty and used to collect discharge from the foot tub 30. The top sections 16, 18 and 20 can be mechanically adjusted to be positioned as desired by the caregiver.

It is envisioned that the table 10 could be used to provide pedicure and reflexology with the use of the foot tub 30. It could also be used to perform operations on the patient's foot. The tub could serve as collection respectable during these procedures.

In other possible embodiments the footbath 30 could include a means to heat the footbath tub 30, means to fill the tub 30 with water or airjets to create a whirlpool action.

The multipurpose table 10 creates a massage table and pedicure "chair" in one device. This eliminates the need for multiple types of tables/chairs. It will allow the patient to receive facials and pedicure in one comfortable setting.

The table 10 also allows the foot therapist to sit in a chair while giving therapy to the patient's feet. It also allows for a convenient means to clean a patient's feet before therapy.

Since obvious changes may be made in the specific embodiment of the invention described herein, each modification being the spirit and scope of the invention claimed it is indicated that all matter contained herein is intended as illustrative and not limiting in scope.

I claim:

1. A treatment table, comprising:

a base frame;

a table top attached above said base frame, said table top having an upper support section, center support section and a caudal support section;

lifts independently coupled to said upper support section, center support section and caudal support section to independently move said upper support section, center support section and caudal support section with respect to said base frame; and a foot tub in said caudal support section.

2. The table as recited in claim 1 wherein said foot tub is permanently inserted into said caudal support section.

3. The table of claim 2 wherein said foot tub has a drain on the bottom of said foot tub.

4. The table of claim 3 wherein said foot tub further comprises a water heater within said foot tub.

5. The table of claim 3 further comprising air-jets in said foot tub.

6. The table of claim 3 further comprising a headrest attached to said upper support section.

7. The table of claim 3 further comprising a foot-rest attached to said caudal support section.

* * * * *